US005299990A

United States Patent [19]

Mehlhoff

[11] Patent Number: 5,299,990

[45] Date of Patent: Apr. 5, 1994

[54] TILTING UNIVERSAL GYM APPARATUS

[76] Inventor: Tracy R. Mehlhoff, 1412 W. 400 North, Orem, Utah 84057

[21] Appl. No.: 996,579

[22] Filed: Dec. 24, 1992

[51] Int. Cl.[5] ..... A63B 21/00

[52] U.S. Cl. ..... 482/38; 482/92; 482/94; 482/115

[58] Field of Search ..... 482/38–42, 482/92, 93–94, 97, 142, 114–119

[56] References Cited

U.S. PATENT DOCUMENTS

| | | | |
|---|---|---|---|
| 277,399 | 5/1883 | Worthington | 482/41 |
| 3,003,765 | 10/1961 | Dove | 482/97 |
| 3,007,699 | 11/1961 | Taylor | 482/97 |
| 3,094,324 | 6/1963 | Shingleton | 482/93 X |
| 3,521,881 | 7/1970 | Schaevitz | 482/38 X |
| 3,944,219 | 3/1976 | LoPresti | 482/38 |
| 4,611,806 | 9/1986 | Terry | 482/41 X |
| 4,620,701 | 11/1986 | Mojden | 482/41 |
| 4,638,995 | 1/1987 | Wilson | 482/38 X |
| 4,666,154 | 5/1987 | Lipscomb et al. | 482/41 X |
| 4,708,340 | 11/1987 | D'Agosta | 482/93 |
| 4,781,374 | 11/1988 | Lederman | 482/38 X |
| 4,789,152 | 12/1988 | Guerra | 482/41 X |
| 4,850,589 | 7/1989 | Block | 482/41 X |
| 5,033,735 | 7/1991 | Erickson | 482/41 X |
| 5,080,352 | 1/1992 | Freed | 482/41 |
| 5,096,187 | 3/1992 | Marples | 482/41 |

FOREIGN PATENT DOCUMENTS

| | | | |
|---|---|---|---|
| 613119 | 9/1979 | Switzerland | 482/93 |

*Primary Examiner*—Robert Bahr

*Attorney, Agent, or Firm*—Marcus G. Theodore

[57] ABSTRACT

A tilting universal gym having an angular pivoting base and support frame adapted to carry removable weights, and which allows the universal gym frame to be operated from a standing position as a hanging bar, and then tipped over to perform weight lifting exercises.

12 Claims, 4 Drawing Sheets

TILTING UNIVERSAL GYM APPARATUS

BACKGROUND OF THE INVENTION

1. Field

This invention relates to weight lifting devices. More particularly it relates to a tilting universal gym system for performing multiple types of exercises.

2. State of the Art

Numerous muscle-building and toning equipment weight lifting and body building apparatuses and devices are known. Generally these muscle-building and toning equipment are either hand held or operated by a user. Examples of hand held muscle-building and toning equipment include: dumbbells, hand grips, hand flexors, scissor grips, power twisters, and tone up wheels. Other user operated muscle building toner equipment are: exercise bikes, neck developers, ankle and wrist weights, triceps exercisers and waist trimmers, free standing weights or barbells, pulling devices, jump rope/skip ropes, etc.

Universal gyms generally have multiple stations designed to improve muscle development through isotonic exercises, such as dead lift and low pulley exercises. A typical universal gym occupies a large floor area and a user moves around the apparatus to perform a number of different exercises at each station. For example, these universal gyms usually have a chinning station with a chinning bar, a dipping station with hip high bars to allow a user to dip and lift to exercise the triceps, an abdominal board station for a user to perform sit-ups, a chest press station with a weight bench where a user pushes up a weighted bar to exercise his chest muscles, a thigh and knee machine station for exercising the legs, a high pulley/lateral pulley bar for a user to pull down and exercise the upper body muscles, a hip flexor station, and a leg press to enable a user to exercise the lower legs. These universal gyms are therefore expensive to construct and own, and take up a significant amount of room. They also cannot be readily adapted for home work-outs.

The present invention provides a small tilting universal gym apparatus designed for gymnasium and home use.

SUMMARY OF THE INVENTION

The present invention comprises a universal gym apparatus which has a frame which tilts on a triangular base so that a user can perform a number of repetitive weight lifting exercises without having to have a separate weight training station. The frame has tiltable open base, i.e. an open angled base having equal sides of sufficient length and with first vertex ends connected at a vertex angle which allows a user to move within an open space defined by the angled sides. The vertex of the base has an elevation member which lifts the vertex of the base sufficiently to shift the majority of the weight of the universal gym apparatus onto the second pivot ends. The sides of the base have pivot ends associated with a pivoting bearing toe members structured to grip a support surface, such as the floor to allow the base and attached frame to tilt in a leaning position mode or remain vertical in a standing mode.

Attached to the angled base are vertical parallel hanging bar tubular supports having open top ends and base ends attached to the sides of the angular base so that they are spaced sufficiently apart to allow a user to position himself therebetween. The hanging bar tubular supports thus form bent lever arms with the base sides to allow the entire frame to pivot as a bent arm lever; thereby providing variable leverage force resistance to a user who grabs the frame at varying distances from the pivot supports.

To provide rigidity to the tubular supports and additional surfaces upon which children can climb, support struts with first ends are attached proximate the second pivoting ends of the angled base. The second ends of the support struts are attached to the vertical tubular members to laterally support the vertical tubular supports. Thus the number and type of support struts are dependent upon the strength and weight of the support materials, as well as the type of climbing areas desired.

To add additional weight to the frame, a vertical weight support tubular member with a bottom end is attached to the vertex of the frame to hold said weight support tubular member in parallel alignment with the hanging bar tubular members. The top end of the vertical weight support tubular member is then adapted to hold removable weights—i.e. disc weights which are slid onto the top end and removably secured thereto when additional weight is required. To support the additional weight, second support struts with first ends are attached proximate the top ends of the vertical parallel hanging bar members. The second ends of the second support struts are then attached proximate the midpoint of the vertical weight support tubular member to rigidly secure the same.

If additional weight is required, the U-shaped frame chinning bar may have weight supports attached to the ends of the chinning bar where additional disc weights may be added to provide the necessary resistance force.

In another embodiment, a support base attached to the tiltable base is structured to allow a user to stand on the same when exercising. Elastic bands of variable resistance are then attached with their first ends secured to the support base, and their second ends secured to the frame to provide the desired force resistance to a user tilting the frame. In this embodiment elastic bands are therefore substituted for the weight supports and disc weights to provide the necessary resistance force. Other force resistant means, such as variable resistant friction bearings associated with the pivot ends, could be used to provide the desired force resistance to a user tilting the frame.

The frame is preferably constructed of a strong heavy metal which not only provides rigidity to the tilting universal gym, but adds weight for a user to lift as part of his exercise regime. It is preferable that the entire frame not be too heavy when tilted, so that a user with lesser strength can lift the same and avoid injury. Additional weights or rubber bands are then utilized to provide the required resistance force for exercising. The frame and hanging bar may also be padded to assist a user in performing exercises and preventing injuries.

The support members of the frame may be welded together into one solid piece, or removably secured so that the various frame components of the tilting universal gym may be disassembled for storage.

A U-shaped tubular hanging bar of sufficient width to allow a user to hang within an opening of the bar has ends which are slideably inserted and removably secured within the top ends of the tubular vertical parallel hanging bar supports. The height of the top of the hanging bar is then adjusted to enable a user to chin himself.

To prevent the apparatus from crushing a user, when tilted, the U-Shaped tubular hanging bar has equal length support arms attached normal to the hanging bar proximate the hanging bar ends to support the tilting universal gym apparatus when tipped over against the floor or supporting surface when doing bench and leg presses. These arm supports, when in the vertical position, are sized of sufficient length to allow a user to hang therebetween to perform bar dips. By thus sizing the arm support to enable dip exercises to be performed, the length is sufficient to prevent the user from being crushed if the tilted apparatus is accidentally is dropped. These arm supports therefore eliminate the need for a spotter when performing heavy lifting exercises, making weight lifting safer. Thus a user can attempt single arm lifts without having to worry about dropping the device.

The tilting universal gym enables a user to do a variety of isometric and non shock aerobic body stretches and exercises to tone and build up most of the body. When in the vertical position, from the chining bar a user can perform chin-ups, bar dips, leg stretch outs, swings, in addition to upside down hanging exercises, such as belly busters, leg pull-ups, etc. with or without elevation boots attached to a user's legs. The vertical frame also provides an ideal climbing jungle gym for small children to use, when not in use as a weight lifting device. To further entertain small children and acquire additional use from the device, a removable basketball standard and hoop may be attached to the frame to enable a user to play basketball. Additional stabilizing members may be attached to the base to provide added stability for heavier use when in the vertical position.

Stretching bands, pulleys or other weight tension devices can also be attached to the frame to perform a variety of stretching exercises for various parts of the body.

To perform presses, squats, curls, and leg presses, the tilting universal gym is tipped, and the user lifts against the chinning bar to perform the various exercises. For example, to do curls, the desired added weight is first attached to the vertical weight support member. The tilting universal gym is then tipped and held by the user proximate his waist. The user then uses his biceps to repetitively lift and lower the tilting universal gym to perform curls.

A weight bench, or other support cushion, may be positioned on the floor to allow a user to lie on the weight bench underneath the tipped tilting universal gym apparatus to bench press or leg lift the U-shaped tubular hanging bar.

The above tilting universal gym thus enables a user to perform the same types of exercises as a conventional universal gym apparatus. It also provides many different types of isometric lifts and presses, as well as stretches, which cannot be performed other machines because of the tilting leverage it can provide. However, it has the added advantage of providing other additional uses to entertain small children when not used as a weight lifting device. It also takes up less space, and can be readily disassembled and stored.

DESCRIPTION OF THE ILLUSTRATED EMBODIMENTS

Figure 1:
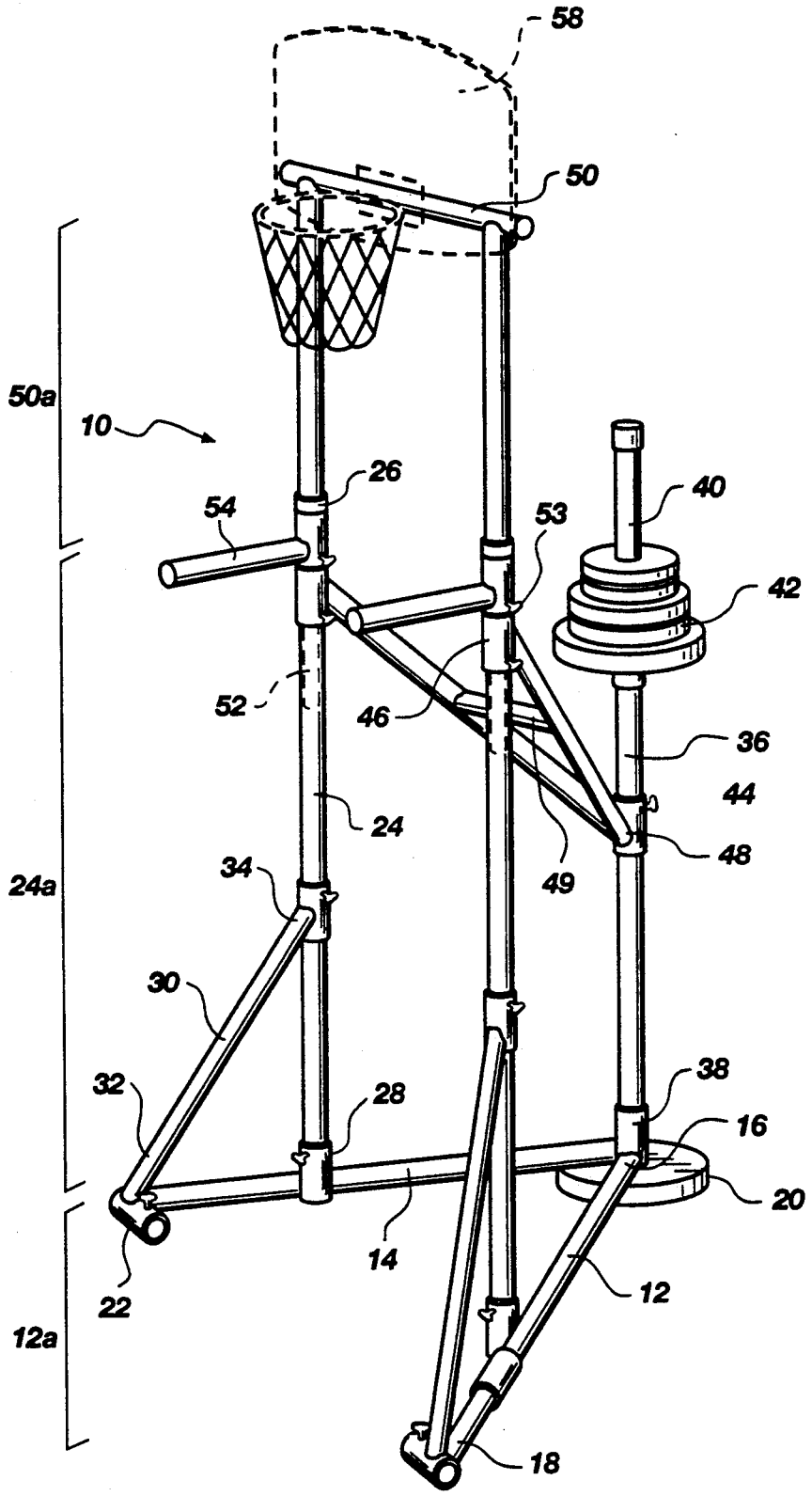
FIG. 1 is a perspective view of one preferred embodiment of the invention.

FIG. 1 illustrates a preferred embodiment of the tilting universal gym invention 10. It has a tilting base assembly 12a comprising an open angled base 12 having equal sides 14 of sufficient length and with first vertex ends 16 connected at a vertex angle which allows a user to move within an open space defined by the angled sides 14. The angled base 12 is constructed of tubular steel with second pivot ends 18 which enable the base 12 to pivot.

An elevation member 20 is associated with the vertex ends 16 to lift the vertex end 16 of the base 12 sufficiently to shift the majority of the weight of the universal gym apparatus 10 onto the second pivot ends 18. Pivoting bearing toe members 22 are attached to the second pivot ends 18 of the angled base 12 and are structured to grip a support surface and allow the base 12 to tilt in a leaning position mode or remain supported against the support surface in a standing mode.

A frame assembly 24a comprising vertical parallel hanging bar tubular support members 24 having top ends 26 and base ends 28 attached to the sides 14 of the base 12 are spaced sufficiently apart to allow a user to position himself therebetween. The hanging bar tubular support members 24 form bent lever arms with the base sides 14 to allow the pivoting bearing toe members 22 to act as a fulcrum to pivot the tilting universal gym apparatus 10.

To provide rigidity, support struts 30 with first ends 32 are attached proximate the second pivoting ends 18 of the angled base 12. The support struts 30 second ends 34 are attached proximate to the vertical tubular members 24 to laterally support said vertical tubular members 24.

A vertical weight support tubular member 36 with a bottom end 38 is attached to the vertex end 16 of the angled base 12 to hold said weight support tubular member 36 in parallel alignment with the hanging bar tubular support members 24. The top end 40 of the weight support tubular member 36 is adapted to hold removable disc weights 42. The vertical support tubular member 36 is rigidly secured in position with second support struts 44 having first ends 46 attached proximate the top ends 26 of the vertical parallel hanging bar support members 24, and second ends 48 attached to the vertical weight support tubular member 36. A cross brace hand and foot grip 49 is secured between the second support struts 44 to enable a user to push against the frame assembly.

A U shaped tubular hanging bar assembly 50a comprised of a hanging bar 50 of sufficient width to allow a user to hang within an opening of the bar has tubular ends 52 slideably inserted and removably secured i.e. screw pins 53 within the top ends 26 of the vertical tubular support members 24. The hanging bar 50 is then adjusted to the desired height.

Figure 6:
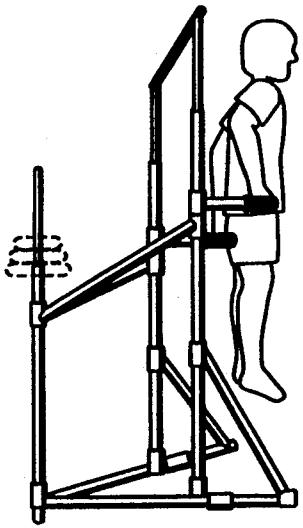
FIG. 6 is a perspective view of the invention shown in FIG. 3.

The tubular support members 24 have equal length support arms 54 attached normal to them proximate the hanging bar ends 52 to support the tilting universal gym apparatus 10 when tipped over against the supporting surface. When in the vertical position, a user can perform dip exercises on the support arms 54 as shown in FIG. 6.

Figure 3:
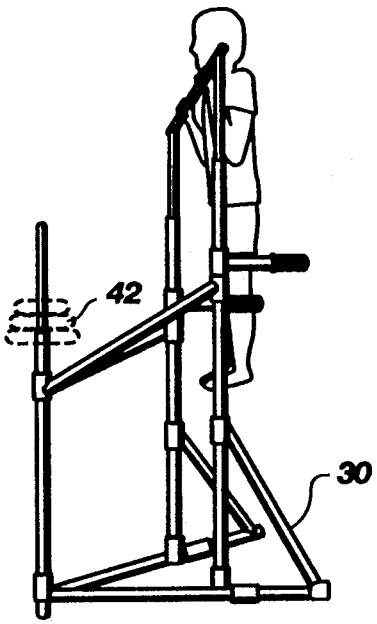
FIG. 3 is another perspective of another embodiment of the invention.
Figure 7:
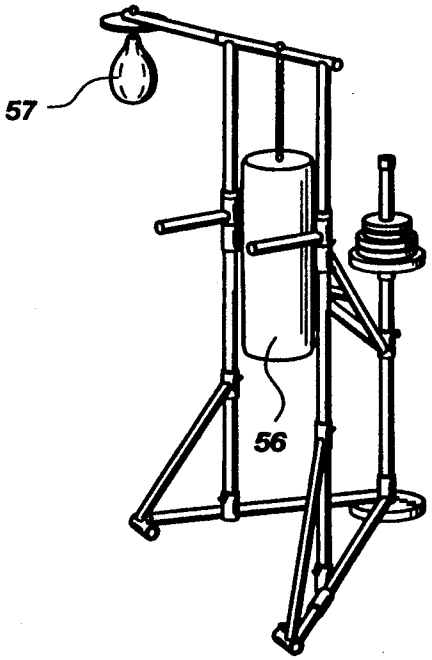
FIG. 7 is a perspective view of another embodiment of the invention.

A user may hang or do chinups from the top of the U-shaped tubular hanging bar 50 of the tilting universal gym apparatus 10 when in a standing position, as shown in FIG. 3. In addition, a punching bag 56 or speed bag assembly 57 may be removable hung from the hanging bar 50 as shown in FIG. 7. Preferably, removable pads (not shown) are attached to the hanging bar 50 and vertical weight support tubular member 36 to cushion the user when applying lifting force to lift the tilting universal gym apparatus 10.

The struts 30, 44 and the vertical tubular support members 24 are preferably removably attached to the frame 12 to enable the apparatus 10 to be disassembled for storage.

A removable basketball standard and hoop 58 shown in FIG. 1 may be attached to the top of the U-shaped tubular hanging bar 50 of the tilting universal gym apparatus 10 when in a standing position to enable a user to play basketball.

Figure 2:
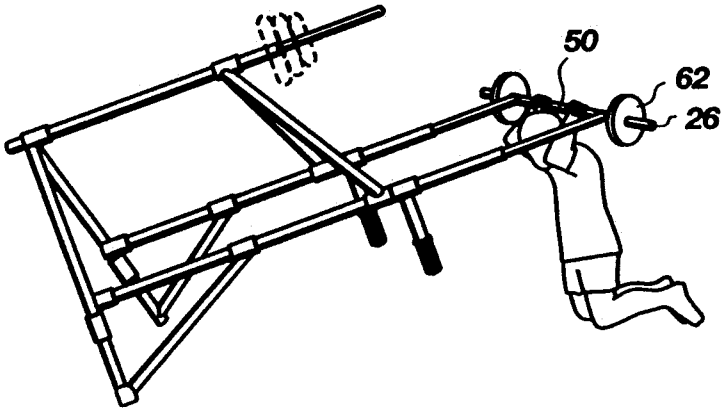
FIG. 2 is a perspective view of another embodiment of the invention.

As shown in FIG. 2, the top of the U-shaped tubular hanging bar 50 may have weight supports 60 attached to its ends from which additional disc weights 62 may be added to provide additional weight to suit the preference of a user performing exercises.

Figure 4:
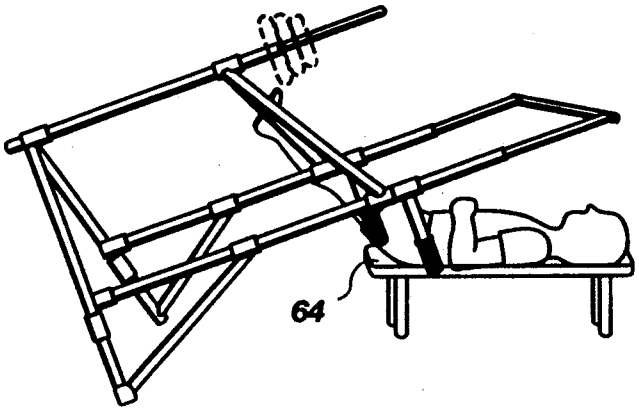
FIG. 4 is another perspective view of the invention shown in FIG. 3.

FIG. 4 shows the apparatus 10 tipped with a user lying on a weight bench 64 positioned on the support surface to allow a user to lie underneath the tipped tilting universal gym apparatus 10 to bench press or leg lift the U-shaped tubular hanging bar 50. By the user performing leg lifts without shoes to push against the hand and foot grip 49, the foot can be massaged.

Figure 5:
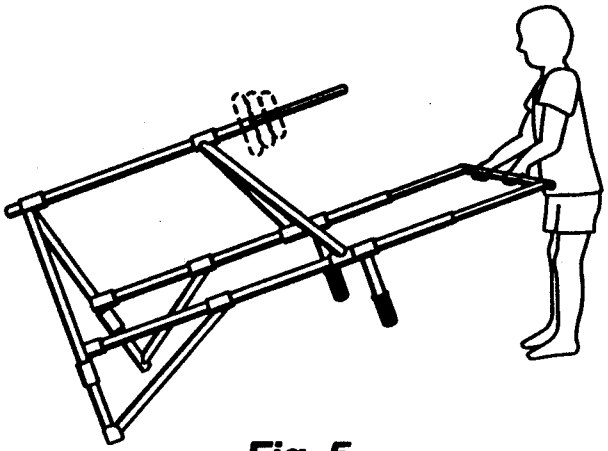
FIG. 5 is another perspective view of the invention shown in FIG. 3.

FIG. 5 shows the apparatus 10 tipped with a user performing curls.

Figure 8:
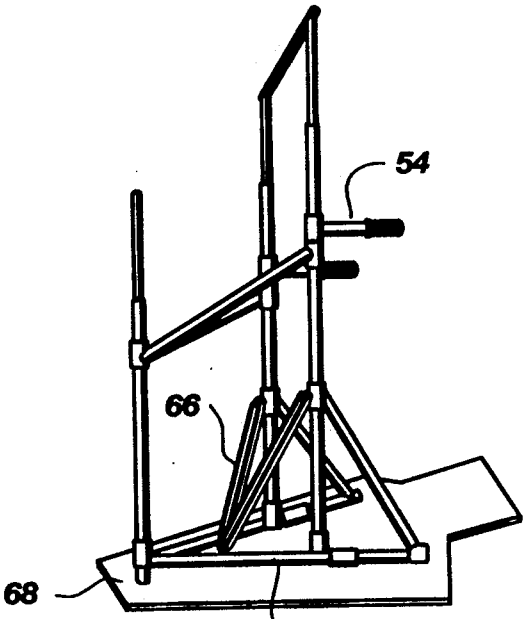
FIG. 8 is a perspective view of another embodiment of the invention.

FIG. 8 shows the apparatus 10 adapted with elastic bands 66 substituted for the weight supports 40 and disc weights 42 to provide the necessary exercise resistance force. The apparatus 10 has a support base 68 attached to the tiltable base 12. The support base 66 is structured to allow a user to stand on the same when exercising. Elastic bands 66 or other tension devices (not shown) of variable resistance are then attached with their first ends secured to the support base 68, and their second ends secured to the frame assembly 12*a* to provide the desired force resistance to a user tilting the frame 12.

Figure 9:
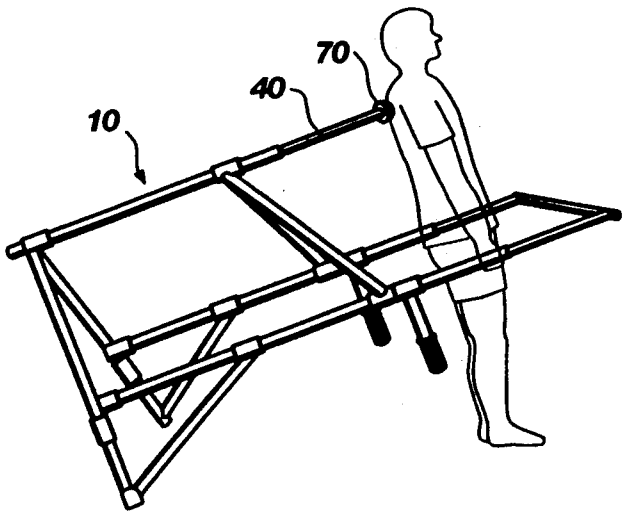
FIG. 9 is a perspective view of another embodiment of the invention.

FIG. 9 illustrates the device 10 adapted with a massage attachment 70 attached to the end of the weight support 40 to enable a user to massage his back.

Although the specification has referred to the illustrated embodiments, it is not intended to restrict the scope of the appended claims. The claims themselves recite those features deemed essential to the invention.

I claim:

1. A tilting universal gym apparatus comprising:

a. a three point tilting base having at least two pivoting second ends, an elevated apex first end to shift weight onto the pivoting second ends which are pivotable against a support surface, said apex first end and said at least two pivoting second ends defining a triangle, and a pair of side members, each said side member connecting one of said at least two pivoting second ends to said apex first end, segments of said side members lying within the triangle defined by said apex first end and said at least two pivoting second ends, said side members spaced sufficiently apart to allow a user to position himself therebetween, and the base structured to lie substantially flat against the support surface in a first mode, and pivot to lift the apex first end as the base is tilted on the pivoting second ends in a second mode;

b. a tiltable support frame having at least two parallel support members with first ends attached at approximately right angles to the tilting base and second ends, c. an extendable chinning bar with extension means extendably attached to the second ends of the support frame to extend the point of attachment of the chinning bar to the frame to a desired length, said frame and chinning bar structured and sized to i. support a user when hanging between the parallel support members from the chinning bar when the frame is held in a vertical position by the base in the first mode; and ii. form a bent arm lever with the triangular base to enable the user to lift and pivot the apparatus by the frame and chinning bar when the frame is held in a tilted position by the base in the second mode, and d. force resistance means located at or in the line extending vertically from at least one of said apex first end or at least one of said at least two pivoting second ends to provide the desired leverage exercise resistance to the chinning bar and support frame when the universal gym apparatus is tilted and pivoted by a user.

2. A tilting universal gym apparatus according to claim 1, wherein the force resistant means comprise removable weights attached to the support frame.

3. A tilting universal gym apparatus according to claim 1, wherein the force resistant means comprise adjustable friction bearings associated with the pivot ends to frictionally retard the support from from pivoting.

4. A tilting universal gym apparatus comprising:

a. an open angled base having equal sides of sufficient length and with first vertex ends connected at a vertex angle which allows a user to move within an open space defined by the angled sides, and second pivot ends, b. an elevation member associated with the vertex ends to lift the vertex of the base sufficiently to shift the majority of the weight of the universal gym apparatus onto the second pivot ends, c. pivoting bearing toe members attached to the second pivot ends of the angled base structured to grip a support surface and allow the base to tilt in a leaning position mode or remain supported against the support surface in a standing mode, d. vertical parallel hanging bar tubular support members having top ends and base ends attached to the sides of the base spaced sufficiently apart to allow a user to position himself therebetween, said hanging bar tubular members forming bent lever arms with the base sides to allow the pivoting bearing toe members to pivot the gym apparatus, e. support struts with first ends attached proximate the second pivoting ends of the angled base, and second ends attached proximate the midpoints of the vertical tubular members to laterally support said vertical tubular members, f. a vertical weight support tubular member with a bottom end attached to the vertex of the frame to hold said weight support tubular member in parallel alignment with the hanging bar tubular members, and its top end adapted to hold removable weights, g. second support struts with first ends attached proximate the top ends of the vertical parallel hanging bar members, and second ends attached proximate the midpoint of the vertical weight support tubular member, and h. a U shaped tubular hanging bar of sufficient width to allow a user to hang within an opening of the bar, having ends slideably inserted and removably secured within the top ends of the tubular vertical parallel hanging bar support members to adjust the height of the top of the hanging bar; said U-Shaped tubular hanging bar having equal length support arms attached normal to the hanging bar proximate the hanging bar ends to support the tilting universal gym apparatus when tipped over against the supporting surface.

5. A tilting universal gym apparatus according to claim 4, wherein the struts are slideably attached to the frame and support members.

6. A tilting universal gym apparatus according to claim 4, wherein the support arms of the U-shaped tubular hanging bar are held parallel the support surface when the universal gym apparatus is not tipped, and are of sufficient length to allow a user to support his weight to perform arm dip exercises.

7. A tilting universal gym apparatus according to claim 4, wherein the top end of the weight support tubular member is adapted to hold a plurality of removable disc weights.

8. A tilting universal gym apparatus according to claim 4, wherein the U shaped tubular hanging bar has weight supports adapted to hold a plurality of removable disc weights.

9. A tilting universal gym apparatus according to claim 4, wherein the components of the tilting universal gym apparatus are constructed of a rigid, weighted material which when tilted provides sufficient weight to a user performing weight lifting exercises.

10. A tilting universal gym apparatus according to claim 4, including a weight bench positioned on the support surface to allow a user to lie on the weight bench underneath the tipped tilting universal gym apparatus to bench press or leg lift the U-shaped tubular hanging bar.

11. A tilting universal gym apparatus according to claim 4, including a removable basketball standard and hoop attached to the top of the U-shaped tubular hanging bar of the tilting universal gym apparatus when in a standing position to enable a user to play basketball.

12. A tilting universal gym apparatus according to claim 4, including weight boots which attach to a user's legs with supports which allow the user to hang from the top of the U-shaped tubular hanging bar of the tilting universal gym apparatus when in a standing position.

* * * * *